US009734925B2

(12) United States Patent
Leister

(10) Patent No.: US 9,734,925 B2
(45) Date of Patent: Aug. 15, 2017

(54) DEVICE FOR LIFTING AND LOWERING LOADS IN VERTICAL SHAFTS, IN PARTICULAR CONTAINERS WITH RADIOACTIVE CONTENTS

(71) Applicant: Peter Leister, Hohentengen (DE)

(72) Inventor: Peter Leister, Hohentengen (DE)

( * ) Notice: Subject to any disclaimer, the term of this patent is extended or adjusted under 35 U.S.C. 154(b) by 0 days.

(21) Appl. No.: 15/100,749

(22) PCT Filed: Dec. 3, 2014

(86) PCT No.: PCT/IB2014/002641
§ 371 (c)(1),
(2) Date: Jun. 1, 2016

(87) PCT Pub. No.: WO2015/082979
PCT Pub. Date: Jun. 11, 2015

(65) Prior Publication Data

US 2016/0300631 A1 Oct. 13, 2016

(30) Foreign Application Priority Data

Dec. 4, 2013 (CH) ..... 2005/13

(51) Int. Cl.
*G21F 5/14* (2006.01)
*B66B 9/02* (2006.01)

(52) U.S. Cl.
CPC ..... *G21F 5/14* (2013.01); *B66B 9/025* (2013.01)

(58) Field of Classification Search
CPC ..... G21F 5/14; B66B 9/025
See application file for complete search history.

(56) References Cited

U.S. PATENT DOCUMENTS 47,761 A * 5/1865 Willard ..... B66B 9/025 187/271
679,142 A * 7/1901 Farmer ..... B66B 9/025 187/271

(Continued)

FOREIGN PATENT DOCUMENTS

FR 2199524 4/1974
JP 2003160286 6/2003

OTHER PUBLICATIONS

International Search report mailed on Feb. 20, 2015, in corresponding International Patent Publication No. PCT/IB2014/002641.

*Primary Examiner* — Michael Riegelman
(74) *Attorney, Agent, or Firm* — Buchanan Ingersoll & Rooney PC

(57) ABSTRACT

A device for lifting and lowering of loads in vertical shafts, in particular of containers with radioactive contents, is disclosed. This device comprises a load platform A, the load thereof being supported by at least four hollow spindles B1, B2, B3, B4 arranged symmetrically in a shaft and having a column-like structure. Each hollow spindle B1, B2, B3, B4 is assembled from individual identical modules C1, C2, C3, C4. Each module C1, C2, C3, C4 consists of a front part 1 and a rear part 2. The rear part 2 has multiple horizontal bores 3, by means of which both a firm anchorage with the shaft wall and a firm screw connection with the front part 1 is enabled. The front part 1 consists of two identical parts 4*a*, 4*b* that form on the front side a longitudinal slit 5.

8 Claims, 8 Drawing Sheets

(56) References Cited

U.S. PATENT DOCUMENTS

| | | | | | |
|---|---|---|---|---|---|
| 828,029 | A * | 8/1906 | Jackson | B66B 9/022 | 187/271 |
| 1,392,078 | A * | 9/1921 | Ouillett | B66B 9/02 | 187/271 |
| 3,851,854 | A * | 12/1974 | Roybal | B66F 11/04 | 182/141 |
| 4,051,923 | A | 10/1977 | Blanchette et al. | | |
| 6,253,878 | B1 * | 7/2001 | Wells | B66B 9/025 | 182/141 |
| 7,328,774 | B2 * | 2/2008 | Molnar | B66B 9/025 | 187/270 |
| 2011/0155509 | A1 * | 6/2011 | Hsieh | B66B 9/025 | 187/267 |
| 2016/0251201 | A1 * | 9/2016 | Cox | B66B 9/025 | |

* cited by examiner

DEVICE FOR LIFTING AND LOWERING LOADS IN VERTICAL SHAFTS, IN PARTICULAR CONTAINERS WITH RADIOACTIVE CONTENTS

CROSS-REFERENCE TO RELATED APPLICATIONS

This application is a U.S. National Stage Application pursuant to 35 U.S.C. §371 of International Patent Application PCT/IB2014/002641, filed on Dec. 3, 2014, and published as WO 2015/082979 on Jun. 11, 2015, which claims priority to Swiss Patent Application 02005/13 filed on Dec. 4, 2013, all of which are incorporated herein by reference in their entireties for all purposes.

TECHNICAL FIELD

The present disclosure is directed to a device for lifting and lowering of loads in vertical shafts, in particular of containers with radioactive contents.

BACKGROUND INFORMATION

In the mining industry are used transportation devices with ropes. The loads are lifted or lowered by means of a load platform or a hoisting cage and with regard to safety reasons with a plurality of steel cables. The parallel connected cables have the purpose that in the case of breaking of one cable the load is held by the remaining cables.

Today it is possible to expand with vertical transportation devices into depths of about 4000 m.

It is also possible to lift loads up to 3000 tons.

Also conveying velocities up to 20 m/s may be achieved.

With transportation devices with ropes these three maxima are not applicable in an additive way.

It is also known that cables may break suddenly because they are exposed to a continuous deterioration, a deformation and in particular an exposure to varying loads.

In the bearer cable technology are used winches on which the cables are recoiled and uncoiled, respectively.

The driving motors of the winches are complemented by technical safety installations in order that in the case of a failure of the driving motors, for example during a power breakdown, the speed can be diminished in a controlled way to "zero" and the load can be held permanently in this slowed down status.

This additional effort in transportation devices with ropes is not safe enough for the lifting and lowering of containers with radioactive contents having a weight of up to 120 tons.

Hoisting devices that use the known principle of the so-called spindle/worm wheel combination do not have these disadvantages.

There exist two different kinds of spindle hoisting gears.

Either the spindles revolve and the worm wheels are trapped in the load platform or the worm wheels turn around the fixed spindles.

In both of these spindle hoisting gears are possible only conveyer heights in the range from only 15 m to 20 m.

This is due to the buckling loads occurring in the spindles at longer conveyer heights and constant diameter of the spindles.

SUMMARY

It is an object of the present disclosure to provide a device for lifting and lowering of loads in vertical shafts, in particular of containers with radioactive contents.

With this device loads up to 120 tons shall become transportable into depths up to 700 m without the risk of a crash.

With this device occasionally occurring buckling loads shall become controllable.

At a power breakdown, according to the principle of the self-locking, this device shall bring to a standstill the movement of the load to be transported without the use of additional energy.

In this device the transfer of forces shall occur form-fit.

In this device the in principle known load platform and the drive devices shall be shaped in such a way that in case of damage, for example by a keying with the mining shaft, no crash of the load can occur.

This device shall also be applicable for the transportation of conventional loads with higher conveying velocity, whereby no long-standing conversions shall be required.

This device shall comprise only a few and constructional simple single parts and shall be based on a modular structure.

With the present disclosure these objects are achieved.

The inventive device for lifting and lowering of loads in vertical shafts, in particular of containers with radioactive contents, is characterized in that this device comprises a load platform A, the load thereof being supported by at least four hollow spindles B1,B2,B3,B4 arranged symmetrically in a shaft and having a column-like structure, whereby each hollow spindle B1,B2,B3,B4 is assembled from individual identical modules C1,C2,C3,C4, whereby each module C1,C2,C3,C4 consists of a front part 1 and a rear part 2, whereby the rear part 2 has multiple horizontal bores 3, by means of which both a firm anchorage with the shaft wall and a firm screw connection with the front part 1 is enabled, whereby the front part 1 consists of two identical parts 4*a*,4*b* that form on the front side a longitudinal slit 5, whereby in the rear part 2 and in the identical parts 4*a*,4*b* are present adapted to each other short bores 30 into which are driven pins for the faucet joints, whereby the identical parts 4*a*,4*b* have multiple horizontal bores 6 that are adapted to the horizontal bores 3 in the rear part 2, whereby through each hollow spindle B1,B2,B3,B4 apiece a worm wheel D1,D2,D3,D4 may be moved both upwards and downwards, in order to transmit the total load, consisting of the bearing load and of the weight of the load platform A, uniformly distributed to the in each case present number of hollow spindles B1,B2,B3,B4, whereby each hollow spindle B1,B2,B3,B4 has in its interior a thread 8 with self-locking for the admission of the worm wheel D1,D2,D3,D4, whereby each worm wheel D1,D2,D3,D4 is held on its upper end 9 and on its lower end 10 by each one bearing device 11*a*,11*b*, whereby these bearing devices 11*a*,11*b* are connected with a driver pointer 12, and whereby the driver pointer 12 is moveable frictionless both upwards and downwards in the longitudinal slit 5 in the front part 1 of each hollow spindle B1,B2,B3,B4, whereby each driver pointer 12 is connected form-fit and force-fit with the load platform A, and whereby either on the head 13 and on the base 14 of each worm wheel D1,D2,D3,D4 is arranged each one driving motor 15*a*,15*b* by which the present worm wheels D1,D2,D3,D4 are set into a rotary motion, or the rotary motion is transmitted through the longitudinal slit 5 by means of shafts from outside on the present worm wheels D1,D2,D3,D4.

Preferred embodiments are also disclosed.

In the following part are described possible embodiments of the present disclosure.

BRIEF DESCRIPTION OF THE DRAWINGS

Thereby reference is made to the Figures.

DETAILED DESCRIPTION

Figure 1:
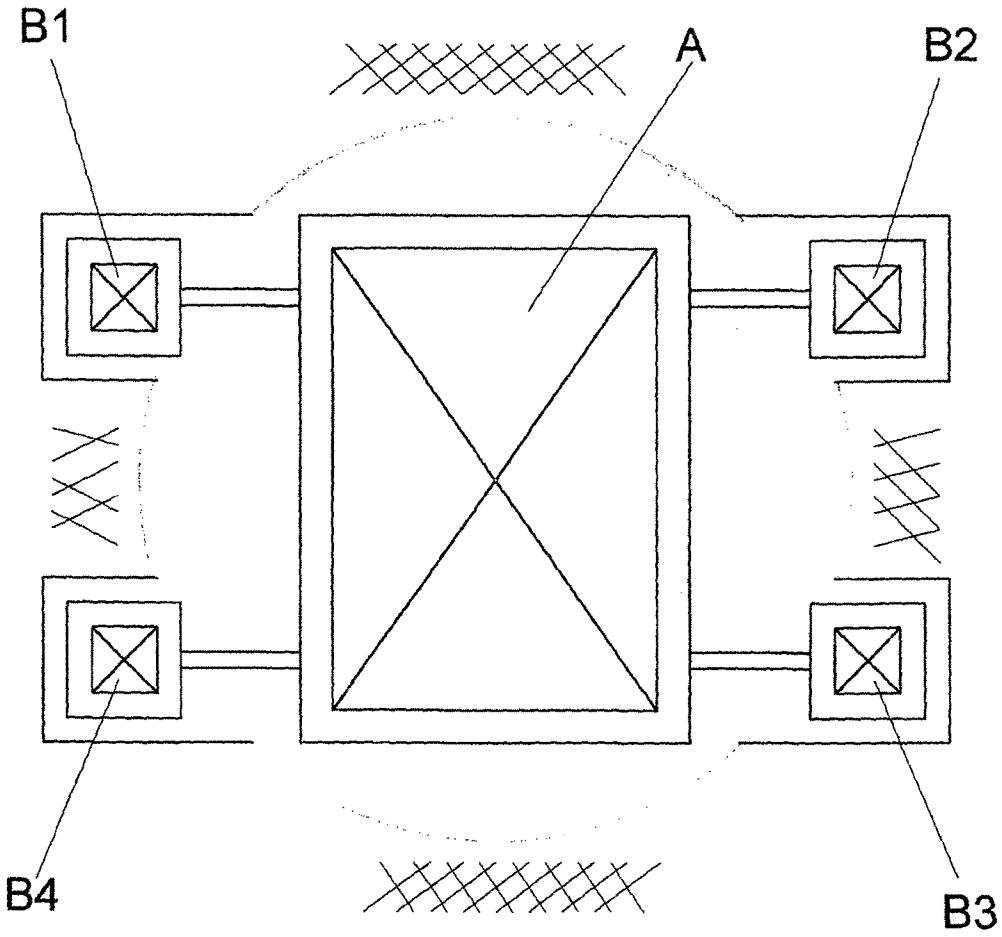
FIG. 1 shows a schematic cross section through an illustrative embodiment of a vertical shaft.

FIG. 1 shows purely schematically a cross section through a vertical shaft wherein are arranged four hollow spindles B1,B2,B3,B4 having a columnar structure and are connected form-fit with the shaft wall.

Figure 2:
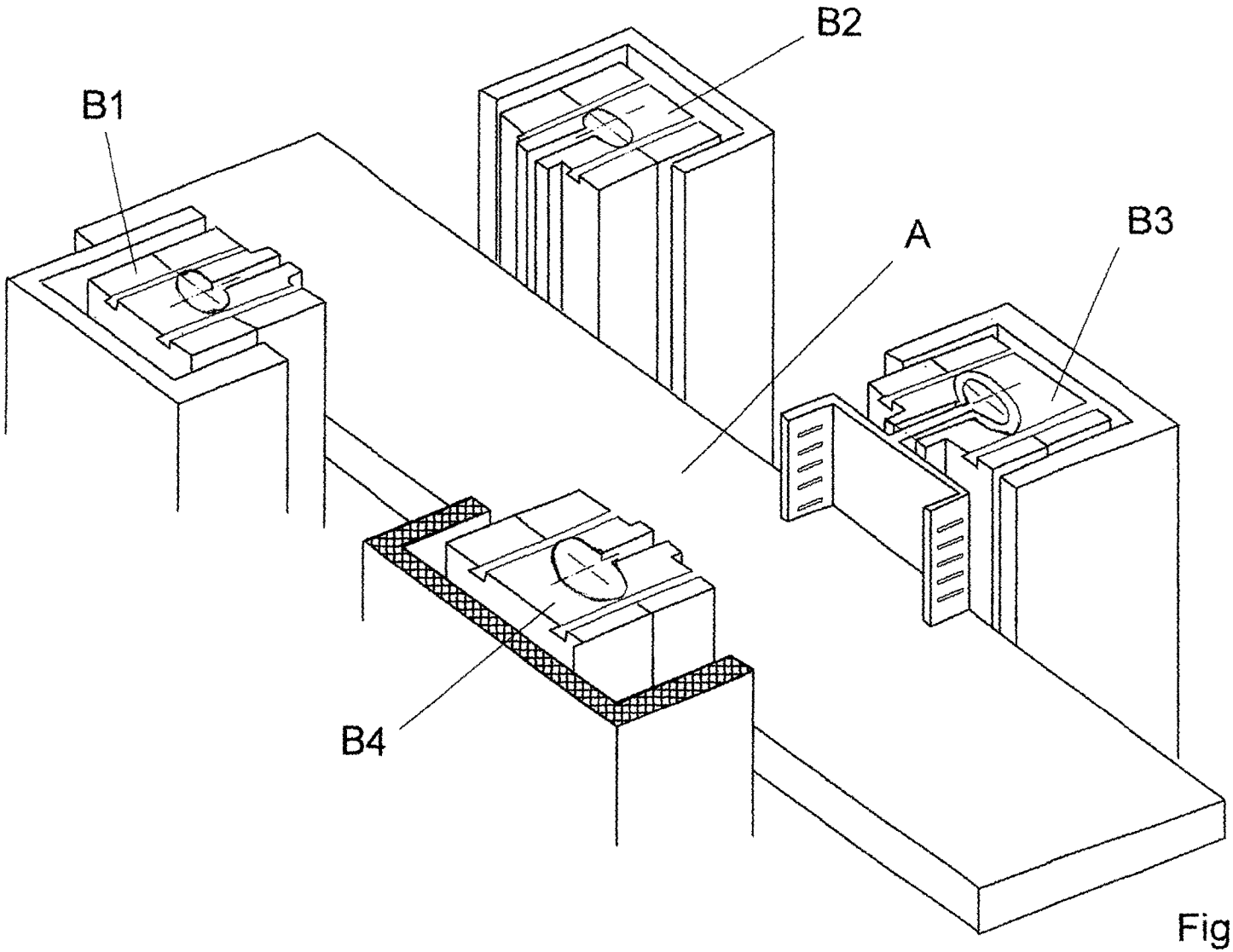
FIG. 2 shows a schematic inclined top view of an illustrative embodiment of a connection of a hollow spindle with a load platform.

FIG. 2 shows purely schematically from the inclined top at one location the connection of the hollow spindle B3 with the load platform A, together with the hollow spindles B1,B2,B4.

Figure 3:
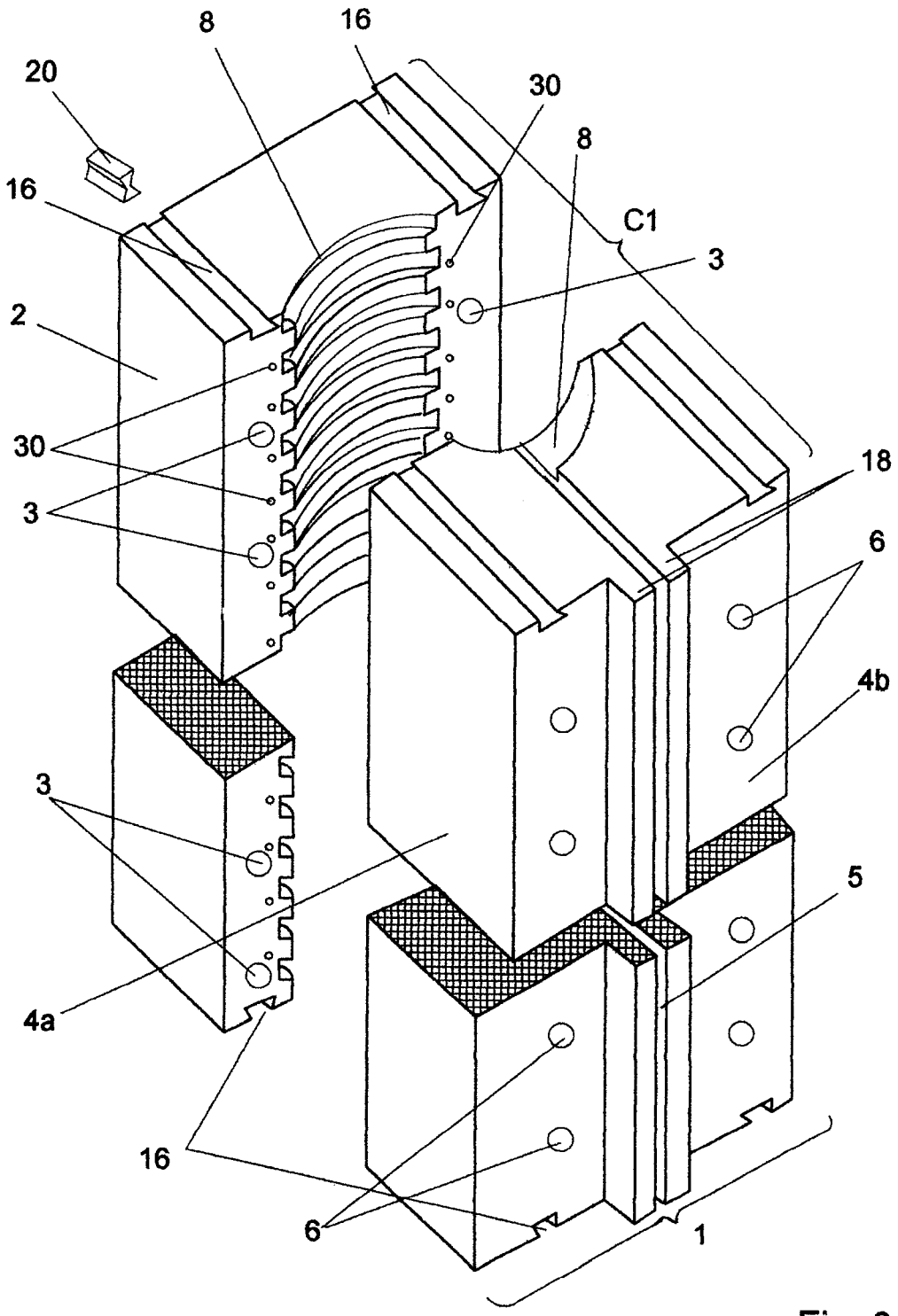
FIG. 3 shows a schematic inclined top exploded view of an illustrative embodiment of a module.

FIG. 3 shows purely schematically from the inclined top an exploded view of the module C1.

Figure 4A:
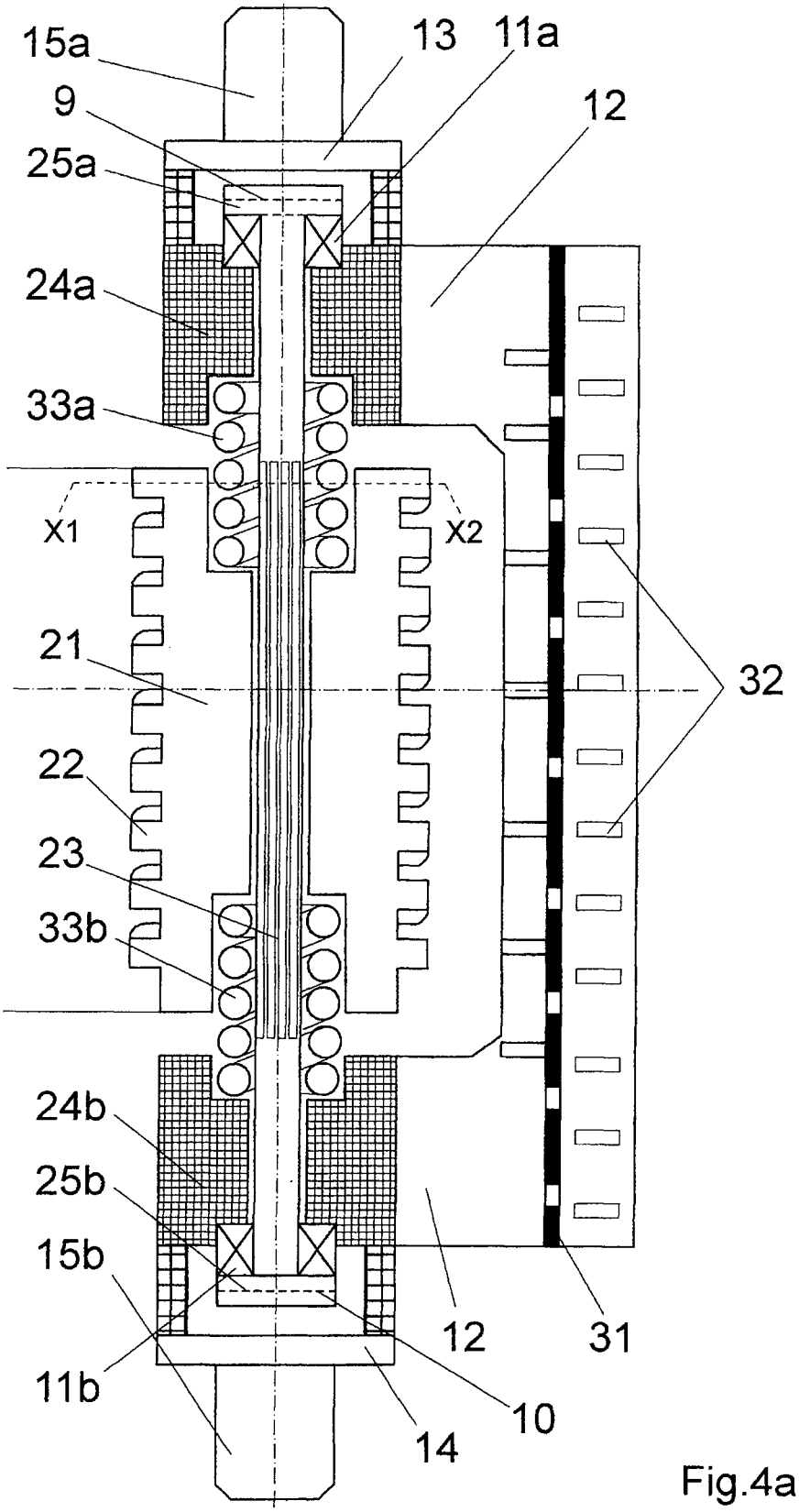
FIG. 4*a* shows a schematic longitudinal section through an illustrative embodiment of a worm wheel together with an illustrative embodiment of a driving pointer and an illustrative embodiment of a driving pointer board.

FIG. 4*a* shows purely schematically a longitudinal section through the worm wheel D1 together with the driving pointer 12 and the driving pointer board 31.

Figure 4B:
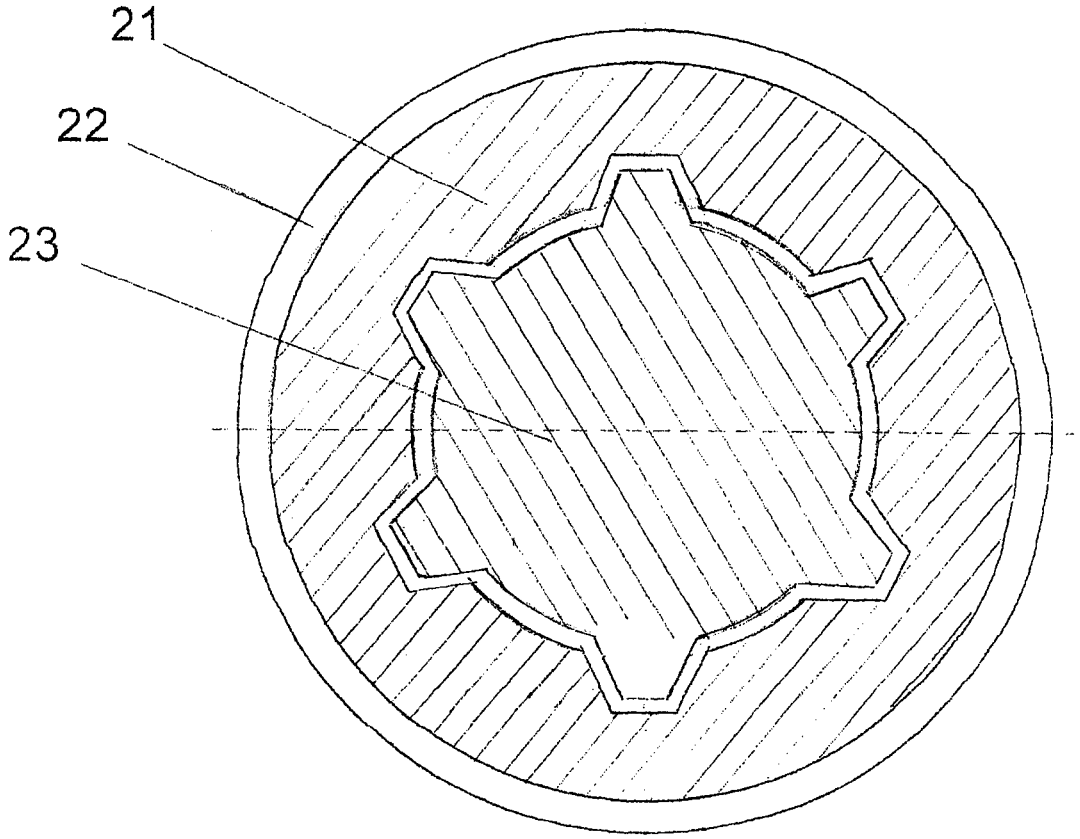
FIG. 4*b* shows a cross section along the line $X_1$ $X_2$ as marked in FIG. 4*a*.

FIG. 4*b* shows a cross section along the line $X_1$ $X_2$ as marked in FIG. 4*a*.

Figure 5:
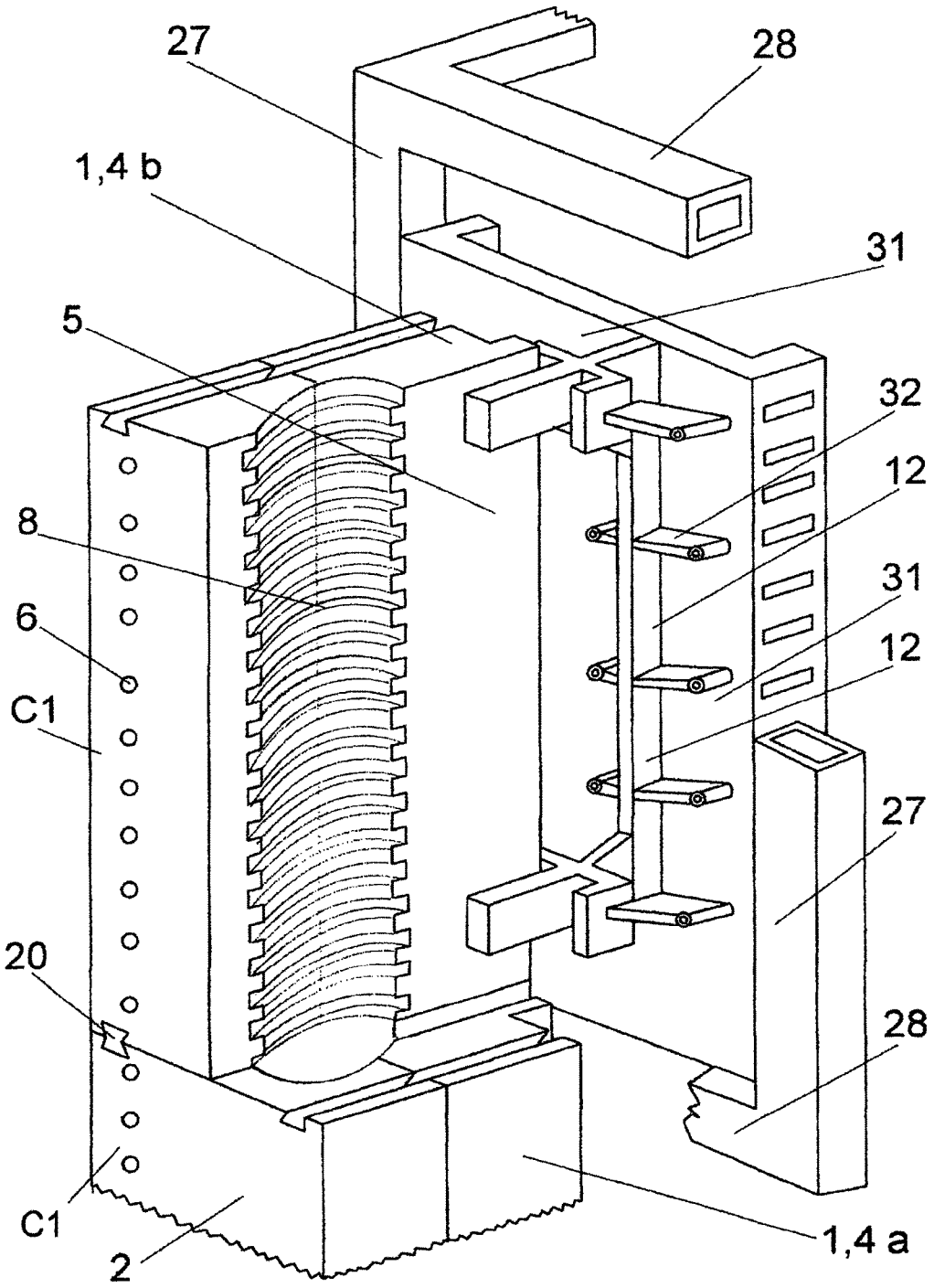
FIG. 5 shows a schematic inclined top view of a partially cut open rear part of an illustrative embodiment of a module.

FIG. 5 shows purely schematically from the inclined top the partially cut open rear part 2 of the module C1. The worm wheel D1 that interferes into the thread 8 is not shown. The driving pointer 12 is shown only partially. The not shown load platform A is connected with the vertical proceeding steel profiles 27 that carry the driving pointer board 31.

Figure 6:
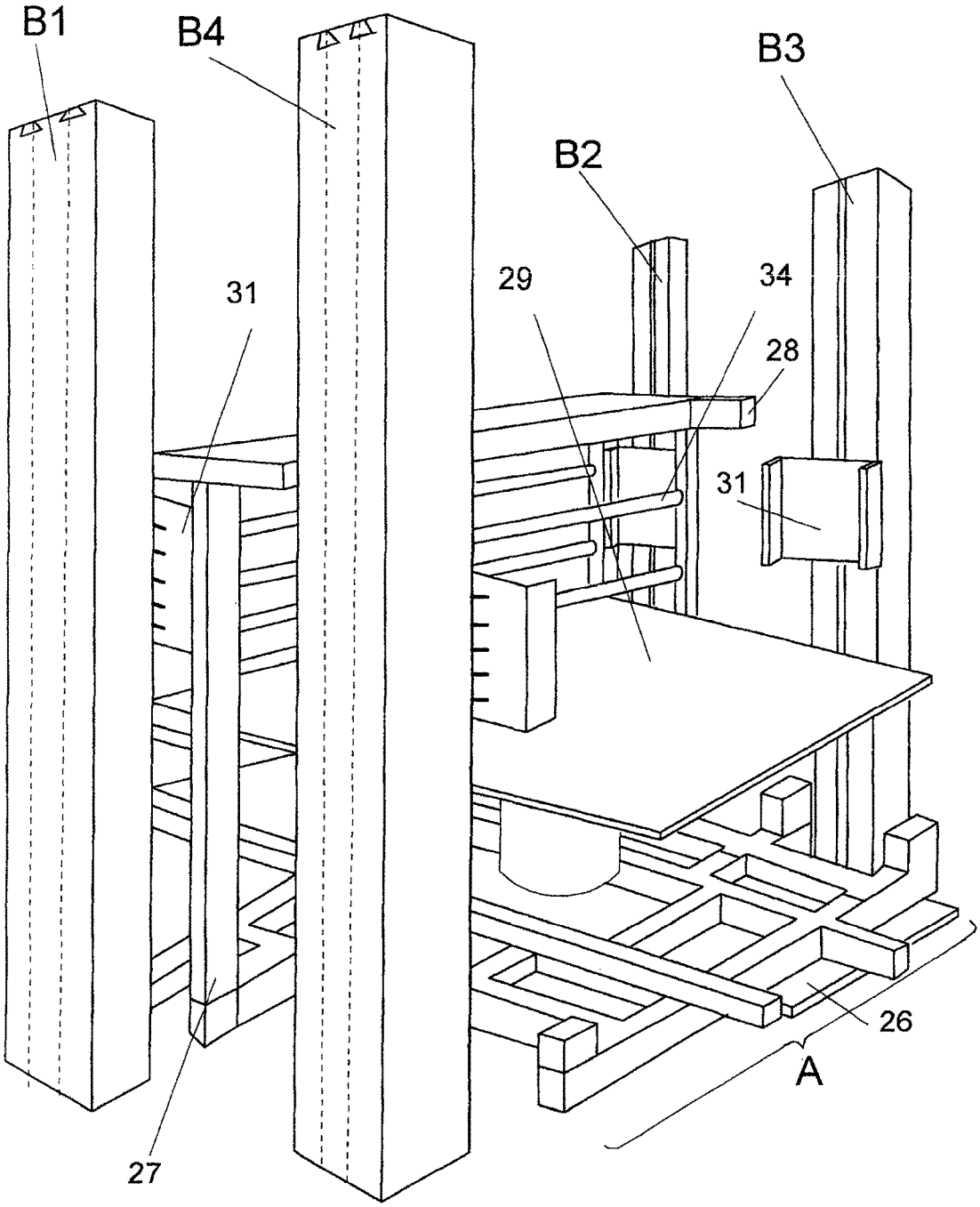
FIG. 6 shows a schematic inclined top view of the structure of an illustrative embodiment of a load platform carried from four driving pointer boards and four hollow spindles.

FIG. 6 shows purely schematically from the inclined top the structure of a possible load platform A carried from four driving pointer boards 31 in interference into the four hollow spindles B1,B2,B3,B4 having a columnar structure.

For the purpose of a better survey four of a total of eight vertical proceeding steel profiles 27 are not shown. The form-fit connections between the hollow spindles B1,B2, B3,B4 and the shaft wall are also not shown.

Figure 7:
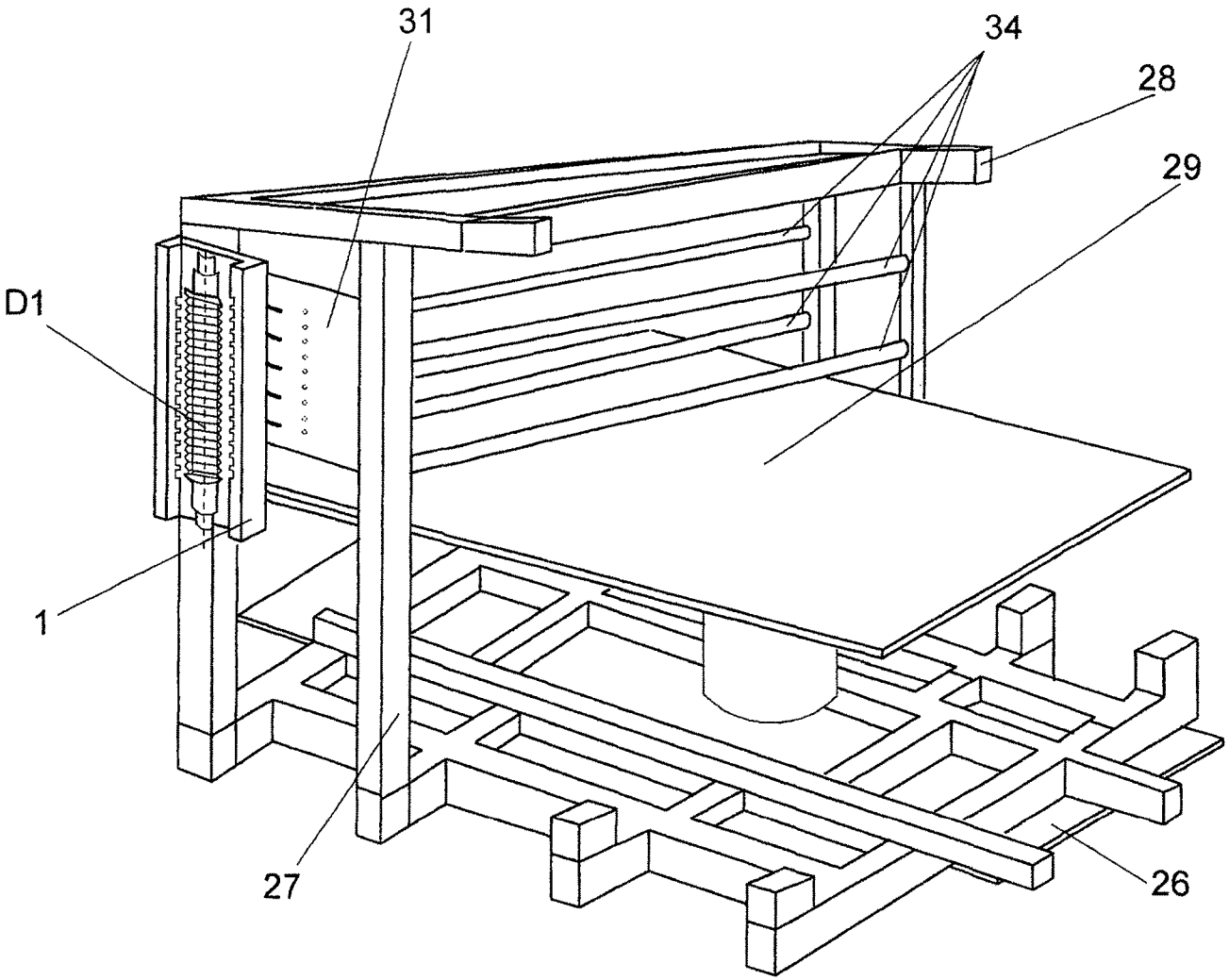
FIG. 7 shows a schematic inclined top view of an illustrative embodiment of a worm wheel together an illustrative embodiment of a module.

FIG. 7 shows purely schematically from the inclined top the beginning of a possible removal of the worm wheel D1 together with the front part 1 of the module C1.

An inventive device for lifting and lowering of loads in vertical shafts, in particular of containers with radioactive contents, can be constructed as follows:

For a module C1 an ashlar-formed roughly forged object is casted from steel having a length of 1 m, a width of 1 m and a height of 4 m and having already the cavities for the parts to be connected of the module and for the thread 8 with self-locking to be introduced as well as the cavity for the longitudinal slit 5.

This roughly forged object is sawed in such a way that front part 1 and the rear part 2 are formed.

Into the rear part 2 and the identical parts 4*a*,4*b* are milled coordinated short bores 30 for the mortise joints. Into these short bores 30 are punched pins.

The identical parts 4*a*,4*b* are connected in a clamped way through the mortise joints with the rear part 2 by means of press fit.

Into the so connected parts is milled the thread 8 with self-locking, preferably a trapezoidal thread.

Thereby is guaranteed that the thread 8 coincides fittingly with the corresponding mating thread 22 in the worm wheel D.

The thread 8 in the module C has preferably a higher hardness than the mating thread 22 in the worm wheel D.

The horizontal bores 3,6 are then completed.

Then the longitudinal slit 5 and the surfaces of the flange like longitudinal tracks 18 are polished.

Into the identical parts 4*a*,4*b* of the front part 1 of a module C may be milled cavities 16 on the upper side and on the underside. Into these cavities 16 may be punched wedges 20. Thereby are retained the individual modules C1,C2,C3,C4 against a possible horizontal displacement.

The required number of modules C as building blocks of a hollow spindle B depends from the conveyer height.

The dimensions of a module C have to be chosen in such a way that the total weight, consisting of the weight of the respective required individual modules C1,C2,C3,C4, the weight of the load platform A and the weight of the load to be transported, can be conducted vertically to the bottom of the shaft.

But it is also possible to deviate partially this total weight into the shaft wall by means of suitable rock anchors that are passed through the horizontal bores 3,6. In this case the dimensions of the individual modules C1,C2,C3,C4 may be reduced.

A worm wheel D is assembled of the following parts:

The cylindrical rotor 21 has on its outside a thread 22 that is adjusted to the thread 8 in the hollow spindles B1,B2,B3, B4 as well as a spline shaft 23 by which the rotor 21 is urged via the electrical driving motors 15*a*,15*b*.

The efficiency of the driving motors 15*a*,15*b* has to be dimensioned in such a way that in the case of a failure of one of these two driving motors 15*a*,15*b* the still intact driving motor can bring alone the required engine torque for the continuation of the ladder.

The driving motors 15*a*,15*b* in the hollow spindles B1,B2, B3,B4 have to be reconciled with regard to their revolution speeds by means of control engineering.

The spline shaft 23 is kept on its both ends from each one bearing block 24*a*,24*b*.

The rotor 21 is connected via the coupling elements 25*a*,25*b* with the electrical driving motors 15*a*,15*b*.

The rotor 21 is pivoted pulsatory by means of the bumper-springs 33*a*,33*b* so that during the transport of the load occasionally occurring shocks may be absorbed and damped. This damping avoids a damage of the threads 8,22.

The bearing blocks 24*a*,24*b* are connected rigidly with the driving pointer 12 made of forged steel. The driving pointer 12 has the form of a handle and is connected form-fit with the load platform A by means of the driving pointer board 31.

The driving pointer board 31 is connected with the driving pointer 12 by means of the stiffening members 32, whereby the connection between the stiffening members 32 and the driving pointer board 31 is preferably shaped detachable, for example by means of screw connections.

The supply of the electrical driving motors 15*a*,15*b* with electricity is effected by means of electric cables that are fixed at the driving pointer 12 and are led to the load platform A.

The load platform A comprises the following parts:

The first, lower bottom 26 serves for the reception of the load to be transported. The first, lower bottom 26 consists of a lattice-work of individual horizontal arranged steel profiles that are preferably arranged rectangular to each other.

The steel profiles can be welded, screwed or clinched together.

On two opposed sides of the load platform A are welded to the first, lower bottom 26 vertical proceeding steel profiles 27, preferably eight vertical proceeding steel profiles 27.

Optionally, the first, lower bottom 26 can be covered or can be equipped with rails.

The vertical proceeding steel profiles 27 are welded with horizontal proceeding upper steel profiles 28, preferably with four horizontal proceeding upper steel profiles 28. Thereby the load platform A is stiffened optimally.

With this construction it is possible to keep down the balance point of the load platform A with or without of the load to be transported.

Above the first, lower bottom 26 in a distance of about 6.5 meters is assembled a second bottom 29. This second bottom 29 is installed for the entering of the operational staff, in order that in the case of a damage a defect worm wheel D may be replaced.

Between the vertical proceeding steel profiles 27 may be arranged four horizontal proceeding, removable transportation rods 34.

For the purpose of the transformation of the load platform A for the transportation of conventional loads the worm wheels D may be drawn either on the shaft head or on the shaft bottom into this second bottom 29.

Additional, conventional bearer cables, preferably eight conventional bearer cables, are linked to two horizontal proceeding upper steel profiles 28.

The load platform A may have in principle any desired form. The load platform A may also be shaped in such a way that it is suitable for the transportation of so-called transport- and storage-containers with radioactive contents, for example "castor"-containers.

Into a not faced shaft having the recesses for the reception of the modules C, the modules C may be assembled earthquake-proof as follows:

In the individual modules C the rear part 2 and the identical parts 4*a*,4*b* of the front part 1 are mortised with each other.

The first mortised modules C1 for each hollow spindle B1,B2,B3,B4 are transported at the same time to the correspondingly prepared baseplate at the shaft bottom.

The front part 1 and the rear part 2 are anchored earthquake-proof with the shaft wall by means of horizontal rock anchors that are passed through the horizontal bores 3,6.

The so anchored first modules C1 are levelled in the required degree.

Into the cavities 16, that are preferably shaped swallow tailed, are punched the wedges 20.

The second modules C2 are placed on the first modules C1 and are anchored and levelled analogously.

With all further modules C the same installation process proceeds, namely until the shaft head is reached.

In the modules C on the top the threads 8 are abraded to the top, allowing without problems during slow rotating thread 22 the mounting of the worm wheels D assembled to the load platform A.

It is also possible that the modules C at the top and at the bottom are assembled without front parts 1. In this embodiment the possibility exists that the worm wheels D may be moved from the second bottom 29 into the corresponding modules C.

The load platform A is now ready for the admission of loads to be transported, in particular of containers with radioactive contents.

Such transports do not require an escort by the operational staff.

Vertical shafts may also be lined, for example with lining segments, in particular lining segments made of steel.

Lining segments are used for example then, when in draw rock layers the mining rock pressure shall be absorbed, in order to avoid rock cutting down from the shaft wall.

Another function of the lining segments may consist therein to not allow the water entry from a permeable rock formation into the shaft.

In shafts that are lined with lining segments the hollow spindles B can be shaped simpler.

The rear parts 2 may be integrated into the lining segments.

By the partial deflection of the vertical forces by means of the lining segments into the rock it is possible to reduce the wall thickness of the hollow spindles B.

This embodiment allows a reduction of the nominal shaft diameter. Thereby the inherent safety of the principle of the hollow spindles is not impaired.

In the following part is pointed to possible malfunctions and to the elimination of possible damages.

The inventive device is shaped in such a way that it is guaranteed in all imaginable failures and damages that the load to be transported may not crash.

During a power breakdown the synchronized threads 8,22 with self-locking prevent without the need of additional energy a crash of the load to be transported.

During the breakdown of one of the driving motors 15*a*,15*b* the still intact driving motor can bring alone the required engine torque for the continuation of the ladder.

When due to any reason the worm wheel D should interlock and the movement of the load platform A is no longer possible, then the respective worm wheel D must be replaced.

This damage can occur in any depth of the shaft and in any case it is guaranteed that the load platform A with the load to be transported may not crash.

Due to the fact that the total length of the worm wheel D is preferably less than the length of a module C, the worm wheel D can be blocked either in a single module C or in two adjacent modules C2,C3.

When in a hollow spindle B1 the worm wheel D1 is blocked in a single module C2 then this damage may be repaired as follows:

The necessary staff for the repair of the damage, together with the required tools and materials, including the new worm wheel D1, is lowered in an auxiliary elevator from the shaft head to the load platform A as far as to the second bottom 29.

After a check, both modules C1,C3 that are located above and below the module C2, in which is located the blocked worm wheel D1, are connected together with subcarriers for the transmission of the vertical forces within the hollow spindle B1.

The wedges 20 are excerpted with hydraulic shaft extractors from the module C2.

In the module C2 are lifted the screw connections between the identical parts 4*a*,4*b* in the front part 1 and the rear part 2. Also the mortise dowel joints between the front part 1 and the rear part 2 are excerpted.

The identical parts 4*a*,4*b* are screwed with the driving pointer board 31. This screw connection results in the fact that the identical parts 4*a*,4*b* may be removed in the same procedure with the worm wheels D1 and may be lodged on the second bottom 29.

The now accessible part of the thread 8 in the rear part 2 is now inspected and occasionally repaired on location.

A new worm wheel D1 is mounted, and the corresponding parts are again fastened by wedges, mortised and screwed together.

Thus, the operational readiness for the continuation of the transport of the load to be transported is restored.

When in a hollow spindle B1 the worm wheel D1 is blocked in two adjacent modules C2,C3 then this damage may be repaired as follows:

The necessary staff for the repair of the damage, together with the required tools and materials, including the new worm wheel D1, is lowered in an auxiliary elevator from the shaft head to the load platform A as far as to the second bottom 29.

After a check, both modules C1,C4 that are located above and below the modules C2,C3, in which is located the blocked worm wheel D1, are connected together with subcarriers for the transmission of the vertical forces within the hollow spindle B1.

The screw connections between the driving pointer board 31 and the driving pointer 12 are lifted, and the driving pointer board 31 is dragged to the second bottom 29.

The wedges 20 are excerpted with hydraulic shaft extractors from the upper module C2.

In the upper module C2 are lifted the screw connections between the identical parts 4*a*,4*b* in the front part 1 and the rear part 2. Also the mortise dowel joints between the front part 1 and the rear part 2 are excerpted.

The identical parts 4*a*,4*b* are laid on the second bottom 29.

The load platform A is moved downwards by means of the three not damaged worm wheels D2,D3,D4 in the hollow spindles B2,B3,B4 so far until the load platform A is located ahead of the module C3.

The blocked worm wheel D1 is secured at the rear part 2 with retaining elements against falling out.

In the lower module C3 are lifted the screw connections between the identical parts 4*a*,4*b* in the front part 1 and the rear part 2. Also the mortise dowel joints between the front part 1 and the rear part 2 are excerpted.

The identical parts 4*a*,4*b* are laid on the second bottom 29.

The now accessible part of the thread 8 in the rear part 2 is now inspected and occasionally repaired on location.

The blocked and secured worm wheel D1 is removed.

A new worm wheel D1 is mounted in the lower module C3, and the corresponding parts are again fastened by wedges, mortised and screwed together.

In an analogous way the upper module C2 is fastened by wedges, mortised and screwed together.

Thus, the operational readiness for the continuation of the transport of the load to be transported is restored.

In the present disclosure are use the following reference numerals:

A load platform
B1,B2,B3,B4 hollow spindle
C1,C2,C3,C4 modules
D1,D2,D3,D4 worm wheels
1 front part
2 rear part
3 horizontal bores
4*a*,4*b* identical parts
5 longitudinal slit
6 horizontal bores
8 thread
9 upper end
10 lower end
11*a*,11*b* bearing device
12 driving pointer
13 head
14 base
15*a*,15*b* driving motors
16 cavities
18 longitudinal tracks
20 wedges
21 rotor
22 thread
23 spline shaft
24*a*,24*b* bearing blocks
25*a*,25*b* coupling elements
26 first, lower bottom
27 vertical proceeding steel profiles
28 horizontal proceeding upper steel profiles
29 second bottom
30 short bores
31 driving pointer board
32 stiffening members
33*a*,33*b* bumper-springs
34 transportation rods.

The invention claimed is:

1. A device for lifting and lowering of loads in a vertical shaft, in particular of containers with radioactive contents, wherein the device comprises a load platform, a load of the load platform being supported by at least four hollow spindles arranged symmetrically in the vertical shaft and having a column-like structure, wherein each hollow spindle is assembled from a respective one of at least four individual identical modules, wherein each module comprises a front part and a rear part, wherein the rear part has multiple first horizontal bores configured to enable both a firm anchorage with a shaft wall of the vertical shaft and a firm screw connection with the front part, wherein the front part consists of two identical parts that form a longitudinal slit on a front side of the front part, wherein the rear part includes first short bores configured to receive driven pins, and the identical parts include second short bores corresponding to the first short bores, wherein the identical parts have multiple second horizontal bores corresponding to the first horizontal bores, wherein at least four worm wheels are each movable both upwards and downwards through a respective one of the at least four hollow spindles, in order to transmit a total load, the total load consisting of a bearing load and of a weight of the load platform, uniformly distributed to the at least four hollow spindles, wherein an interior of each hollow spindle has a thread with self-locking configured to receive a corresponding one of the at least four worm wheels, wherein each worm wheel possesses an upper end and a lower end, and is held on the upper end by a first bearing device and on the lower end by a second bearing device, wherein the first and second bearing devices are connected with a driver pointer, and wherein the driver pointer is moveable both upwards and downwards in the longitudinal slit of a corresponding one of the at least for hollow spindles, wherein each driver pointer is connected in a form-fit and force-fit manner with the load platform, and wherein either:

on a head and on a base of each worm wheel is arranged a respective driving motor by which the each worm wheel is set into a rotary motion; or a rotary motion of each worm wheel is transmitted through the longitudinal slit by an outside shaft from outside to the worm wheel.

2. The device according to claim 1, wherein the identical parts of the front part have cavities on the front side on both an upper end and a lower end of the identical parts, in order that two of the front parts arranged one upon the other are combinable in a form-fit manner by removable butt straps or wedges.

3. The device according to claim 1, wherein longitudinal tracks are located on the identical parts of the front part on the front side thereof and are adjacent to the longitudinal slit.

4. The device according to claim 1, wherein the front part and the rear part of each module are made of cast steel.

5. The device according to claim 1, wherein a length of one of the at least four modules is adjusted to a length of a corresponding one of the at least four worm wheels.

6. The device according to claim 5, wherein a total length of the corresponding one of the at least four worm wheels is less than the length of the one of the at least four modules.

7. The device according to claim 1, wherein the driving pointer is made of forged steel.

8. The device according to claim 1, wherein the respective driving motor is an electric motor.

* * * * *